US007893401B2

(12) United States Patent
Ding

(10) Patent No.: US 7,893,401 B2
(45) Date of Patent: Feb. 22, 2011

(54) MASS SPECTROMETER USING A DYNAMIC PRESSURE ION SOURCE

(75) Inventor: Li Ding, Sale (GB)

(73) Assignee: Shimadzu Research Laboratory (Europe) Limited, Manchester (GB)

( * ) Notice: Subject to any disclaimer, the term of this patent is extended or adjusted under 35 U.S.C. 154(b) by 123 days.

(21) Appl. No.: 12/158,458

(22) PCT Filed: Dec. 20, 2006

(86) PCT No.: PCT/GB2006/004804

§ 371 (c)(1),
(2), (4) Date: Sep. 10, 2008

(87) PCT Pub. No.: WO2007/071991

PCT Pub. Date: Jun. 28, 2007

(65) Prior Publication Data

US 2009/0045334 A1 Feb. 19, 2009

(30) Foreign Application Priority Data

Dec. 22, 2005 (GB) ..... 0526245.6

(51) Int. Cl.
*H01J 49/04* (2006.01)

(52) U.S. Cl. ..... 250/288

(58) Field of Classification Search ..... 250/288, 250/289, 290, 292, 281, 282
See application file for complete search history.

(56) References Cited

U.S. PATENT DOCUMENTS 5,237,175 A * 8/1993 Wells ..... 250/288
5,965,884 A 10/1999 Laiko et al.
6,331,702 B1 12/2001 Krutchinsky et al.
6,483,109 B1 11/2002 Reinhold et al.
6,515,280 B1 2/2003 Baykut
6,555,814 B1 4/2003 Baykut et al.
6,576,893 B1 6/2003 Kawato et al.
6,670,606 B2 * 12/2003 Verentchikov et al. ..... 250/287
6,794,642 B2 9/2004 Bateman et al.

(Continued)

OTHER PUBLICATIONS

Kofel et al., "Matrix-assisted Laser Desorption/Ionization Using a New Tandem Quadrupole Ion Storage Trap, Time-of-flight Mass Spectrometer," Rapid Communications in Mass Spectrometry, vol. 10, 658-662 (1996).

(Continued)

*Primary Examiner*—Kiet T Nguyen
(74) *Attorney, Agent, or Firm*—Stites & Harbison PLLC; Douglas E. Jackson

(57) ABSTRACT

A mass spectrometer has a pulsed ion source, a first ion trap (10) for trapping ions generated by the pulsed ion source and for locating trapped ions for subsequent ejection from the first ion trap. A pulse of cooling gas is introduced into the first ion trap (10) at a peak pressure suitable for enabling the first ion trap (10) to trap ions. A turbomolecular pump (17) reduces the pressure of cooling gas before the trapped ions are ejected from the first ion trap (1) towards a second ion trap (20) for analysis. The pulsed ion source has a sample plate (14) which forms an end wall of the first ion trap (10).

27 Claims, 7 Drawing Sheets

U.S. PATENT DOCUMENTS

| | | | |
|---|---|---|---|
| 6,849,847 | B1 | 2/2005 | Bai et al. |
| 6,946,653 | B2 | 9/2005 | Weinberger et al. |
| 2004/0079875 | A1 | 4/2004 | Ding |
| 2005/0029448 | A1 | 2/2005 | Chang et al. |
| 2005/0092912 | A1 | 5/2005 | Krutchinsky et al. |

OTHER PUBLICATIONS

Witt et al., "In-Source H/D Exchange and Ion-Molecule Reactions Using Matrix Assisted Laser Desorption/Ionization Fourier Transform Ion Cyclotron Resonance Mass Spectrometry with Pulsed Collision and Reaction Gases," J Am Soc Mass Spectrom 2002, 13, 308-317.

* cited by examiner

MASS SPECTROMETER USING A DYNAMIC PRESSURE ION SOURCE

This invention relates to a mass spectrometer; particularly a mass spectrometer having a pulsed ion source, such as a Matrix Assisted Laser Desorption Ionisation (MALDI) ion source.

The MALDI ion source has been widely used for biochemical analysis. Typically, a MALDI ion source includes sample mixed with a radiation absorbing material to form a matrix which is deposited on a surface of a sample plate; this assists ionisation of sample following irradiation of the matrix by a laser pulse.

A known instrument comprises a MALDI ion source in combination with a Time-of-Flight (TOF) mass spectrometer; however, this instrument only allows simple MS analysis to be performed. In order to couple the MALDI ion source to other, more versatile types of mass analyser, or to develop hybrid systems suitable for carrying out tandem mass analysis, different kinds of MALDI-MS interface have been developed over the past decade. In general, ions generated by a pulsed ion source, such as a MALDI ion source, have energies proportional to their masses, and ions having the highest masses have the widest energy distributions. For example, ions having a mass of 10,000 Da, say, and having a maximum velocity of 1200 $msec^{-1}$ may have kinetic energies as high as 75 eV. Such high energy ions present a problem when designing an interface between a pulsed ion source, such as a MALDI ion source, and a mass analyser.

U.S. Pat. No. 6,576,893 describes a method for introducing ion pulses generated by a MALDI ion source into an ion trap, via a high vacuum electrostatic lens, by application of a pulsed retardation voltage. This method enables ions of high mass to undergo mass analysis in the ion trap itself, or to be ejected from the ion trap for subsequent analysis in a TOF analyser. Although, a pulsed retardation voltage is effective to reduce the kinetic energy of the ions it cannot reduce internal energy acquired by the ions as a result of the ionisation process, and this can give rise to unwanted fragmentation of the trapped ions.

U.S. Pat. No. 6,331,702 describes a different technique whereby ions generated by a MALDI ion source are transmitted to an orthogonal TOF analyser via an ion path including a multipole ion guide. The ion guide functions as an interface between the MALDI ion source and the mass analyser and is effective to convert pulsed ions to a quasi-continuous ion beam. A quasi-continuous beam of ions is needed for a quadrupole analyser or a fast pulsing orthogonal TOF. By contrast, continuous introduction of ions into a quadrupole ion trap is difficult.

High mass protein ions (e.g. ions having masses in excess of 10,000 Da) have high kinetic energies which must be reduced significantly before the ions can be accepted into the multipole ion guide. This necessitates providing a cooling gas in the ion path in order to cool the ions and thereby reduce their energy. However, in order to achieve this, the cooling gas needs to be maintained at a relatively high pressure, typically greater that $10^{-2}$ mbar, and this may give rise to problems such as electrical discharge in the ion guide. In order to overcome this problem differential pumping is adopted so that a lower gas pressure may be used in the ion guide than in the source region, but this adds to the complexity and cost of the system. Furthermore, even at a pressure as low as $10^{-2}$ mbar, axial motion of ions within the ion guide is effectively brought to a halt, significantly reducing the efficiency with which ions may be transferred to the analyser for analysis. US Patent Publication No. 2005/0092912 describes provision of an axial electric field which is used to accelerate ions along the ion guide to improve the efficiency of transfer, but this adds yet more complexity and cost to the system.

EP 0964427 A2, U.S. Pat. No. 5,965,884 and U.S. Pat. No. 6,946,653 also describe use of ambient gas to reduce both the kinetic and internal energies of ions generated by MALDI ion sources. Because no effective electrostatic lens system can be incorporated in the source region where high pressure exists, high efficiency of transmission is difficult to achieve. Also, the pulsed nature of the source is not preserved and so this technique cannot be used for ion trap mass analysers.

A paper entitled "Matrix Assisted Laser Desorption/Ionisation Using a New Tandem Quadrupole Ion Storage Trap, Time of Flight Mass Spectrometer" P. Kofer, Rapid Communications in Mass Spectrometry Vol. 10, 658-662, 1996 describes use of pulsed gas to cool ions generated by a MALDI ion source in a hyperboloid 3-D ion trap. In this case, the MALDI sample is deposited on the tip of a sample probe mounted in the entrance end cap electrode of the hyperboloid 3-D ion trap. However, this arrangement is unsatisfactory because it limits both the volume and spatial distribution of sample presented for analysis and, in particular, prevents analysis of multiple samples, during the same session. Furthermore, surface contamination of the ring electrode and the end cap electrodes of the ion trap is likely to occur and this degrades the analytical performance of the ion trap.

It is an object of the invention to provide a mass spectrometer having a pulsed ion source, such as a MALDI ion source, which at least alleviates the foregoing problems. More specifically, it is an object of the invention to reduce the kinetic and internal energies of ions generated by the pulsed ions source in order that they may be efficiently delivered to and trapped within an ion trap of the mass spectrometer for mass analysis.

According to one aspect of the invention there is provided a mass spectrometer including:

- a pulsed ion source,
- a first ion trap for trapping ions generated by the pulsed ion source and for locating trapped ions for subsequent ejection from the first ion trap,
- gas inlet means for introducing a pulse of cooling gas into said first ion trap at a peak pressure suitable for enabling the first ion trap to trap said ions,
- pump means for reducing pressure of said cooling gas before the trapped ions are ejected from the first ion trap, and
- a second ion trap for receiving and analysing ions ejected from the first ion trap, said pulsed ion source including a flat sample plate on which sample is deposited and which forms an end wall of the first ion trap, whereby said pulsed ions are generated inside the first ion trap.

A reduced gas pressure is beneficial because it allows migration of trapped ions to a low energy region of the first ion trap from which the ions may be ejected over a relatively short time span. Therefore, this measure may improve the efficiency with which trapped ions are transferred from the first to the second ion trap. The reduced gas pressure also allows mass analysis to be performed in the second ion trap which may share the same vacuum chamber without using differential pumping.

Said pump means may be a vacuum pump, such as a turbomolecular pump.

Said gas inlet means may include an electromagnetically-driven valve, such as a solenoid valve, or a piezoelectrically-driven valve. Typically, said gas inlet means introduces said pulse of cooling gas into the first ion trap at a peak pressure in the range from $5\times10^{-2}$ mbar to 1 mbar, and said pump means reduces that pressure to a pressure less than $5\times10^{-3}$ mbar.

Said valve is preferably held open for a period less than the pump down time constant achieved by said pump means, preferably less than 5 ms.

Preferably, there is a preset delay between activation of said gas inlet means and subsequent activation of said pulsed ion source.

In preferred embodiments, the pulsed ion source is a MALDI ion source.

The first ion trap may be a multipole (preferably a quadrupole) linear ion trap having a plurality of poles arranged symmetrically around a longitudinal axis of the ion trap.

In preferred embodiments of the invention, said multipole linear ion trap may include a gate electrode located at a rear end of said first ion trap, said gate electrode being selectively biased, in use, to reflect or eject ions.

Said gate electrode may be biased to create an axial DC potential well in the first ion trap whereby to locate a cloud of said trapped ions in the first ion trap prior to their ejection from the first ion trap. The multipole linear ion trap may be a segmented multipole (e.g. a quadrupole) linear ion trap wherein each pole includes a relatively short segment adjacent to said rear end of the first ion trap, each said relatively short segment being biased to augment said DC axial potential well. Alternatively, a ring electrode may be provided between the gate electrode and the poles of the multipole linear ion trap, the ring electrode being biased to augment said DC axial potential well.

With this biasing arrangement trapped ions can migrate axially within the multipole linear ion trap as the pressure of cooling gas is reduced by said pump means, coming to rest at the bottom of said DC potential well where they may congregate to form a short, ovoid ion cloud which may readily be ejected from the first ion trap. Said gate electrode may be biased to subject ions to an electrostatic accelerating force towards the gate electrode causing their ejection from the first ion trap towards the second ion trap.

In another preferred embodiment of the invention, said first ion trap is a cylindrical ion trap including a ring electrode having a longitudinal axis, wherein said flat sample plate forms an end wall of the ion trap at a front end thereof and a gate electrode forms an end wall of the ion trap at a rear end thereof.

In the case of a cylindrical ion trap, DC biasing means may be arranged to establish a dipole electric field between said flat sample plate and said gate electrode to cause ejection of trapped ions from the first ion trap, and said second ion trap is arranged to establish a further dipole electric field for retarding the ejected ions.

The second ion trap may be of any suitable form capable of receiving ejected ions and performing mass analysis on ions so received, including a quadrupole linear ion trap which may be a segmented quadrupole linear ion trap or a hyperboloid 3-D ion trap.

The first and second ion traps may both be linear ion traps, which may be segmented linear ion traps. In some embodiments, the first and second ion traps are arranged in series on a common longitudinal axis whereas, in other embodiments, the first and second ion traps are arranged side-by-side on mutually parallel axes and means for ejecting trapped ions is arranged to eject ions from the first ion trap to the second ion trap in a direction orthogonal to said parallel axis. The first and/or second ion traps may have a tunnel structure formed from printed circuit board bearing electrically conductive tracks to which high frequency drive and DC bias voltages are applied in use.

Embodiments of the invention are now described, by way of example with reference to the accompanying drawings of which:

Figure 3A:
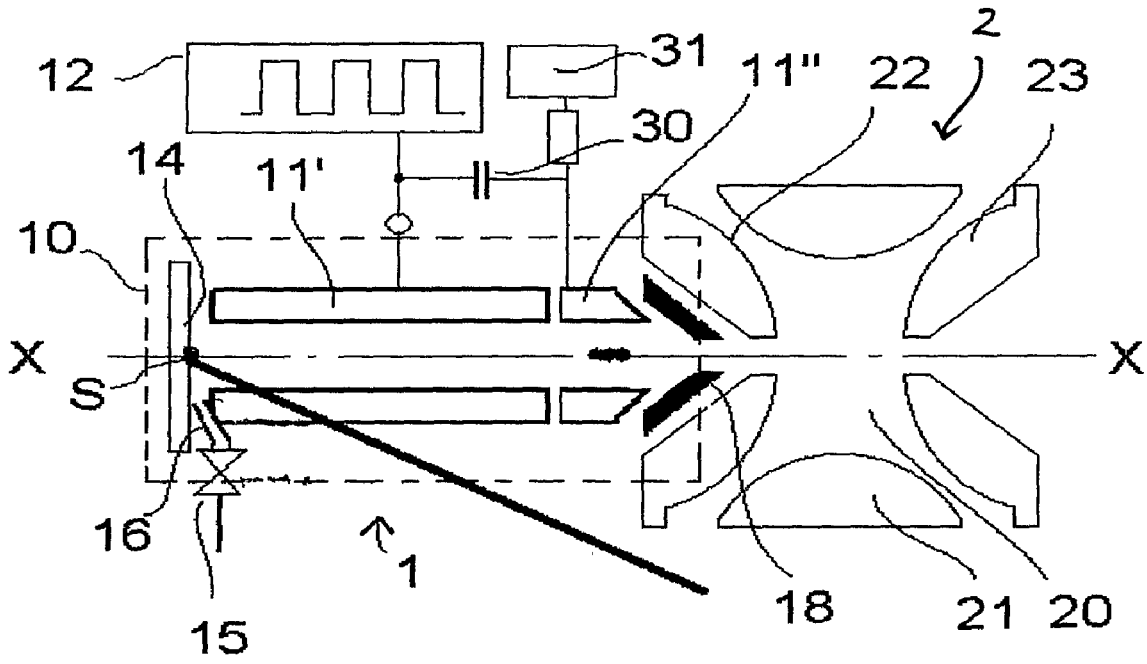
Figure 3:
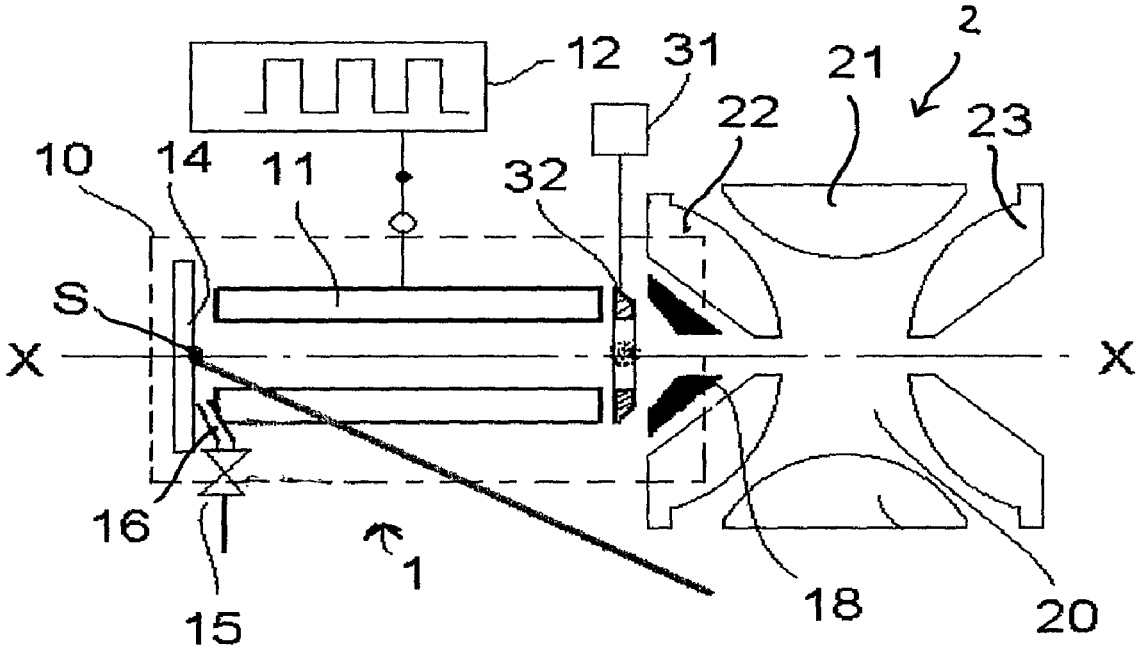
Figure 4:
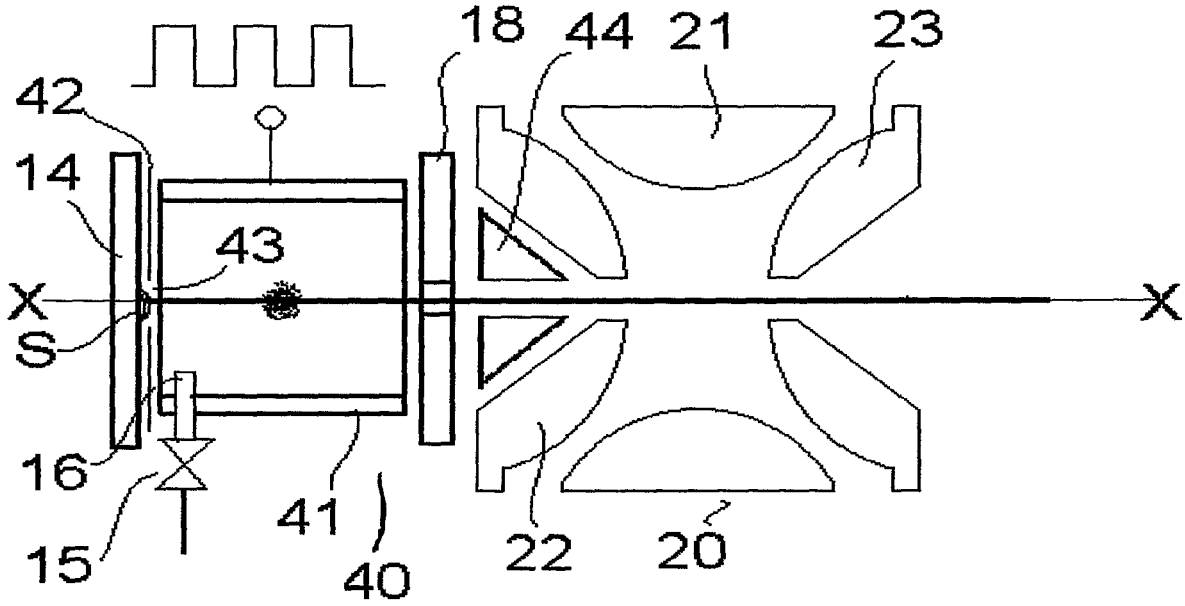
Figure 5:
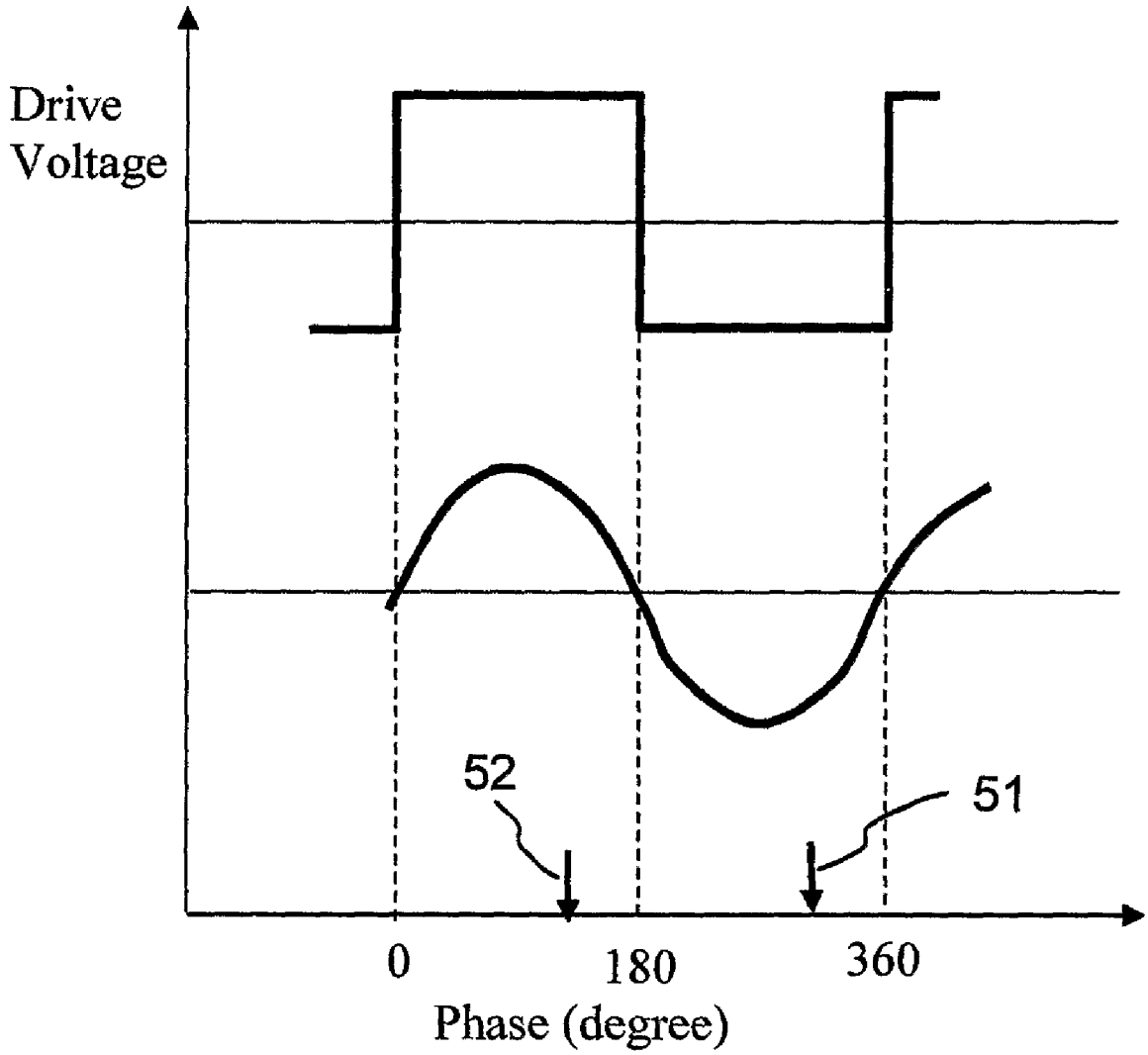
Figure 6:
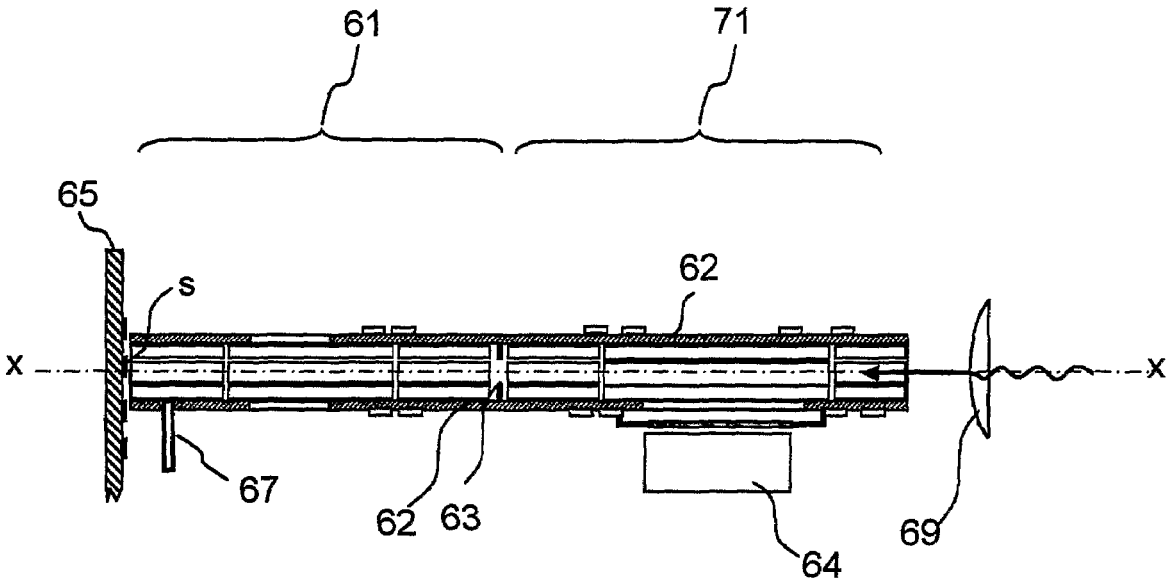
Figure 7:
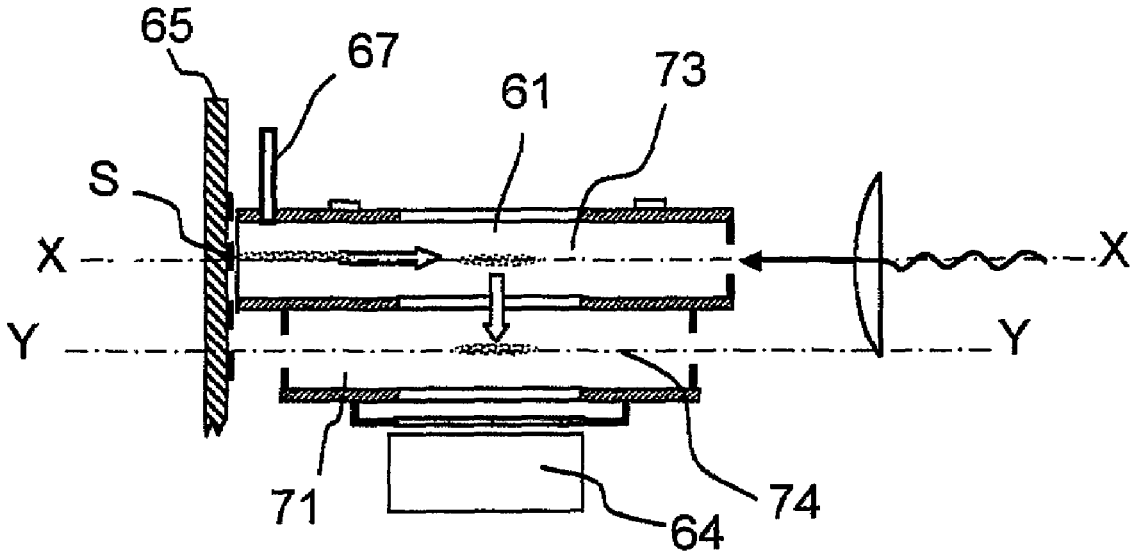

FIGS. 3(*a*) and (*b*) are diagrammatic, longitudinal cross-sectional representations of other mass spectrometers according to the invention, FIG. 4 is a diagrammatic, longitudinal cross-sectional representation of yet another mass spectrometer according to the invention, FIG. 5 illustrates the optimum timing a pulse of laser radiation with respect to a rectangular waveform drive voltage and a sinusoidal waveform drive voltage applied to the ring electrode of the cylindrical ion trap described with reference to FIG. 4, and FIGS. 6 and 7 are diagrammatic, longitudinal cross-sectional representations of yet further mass spectrometers according to the invention.

Figure 1:
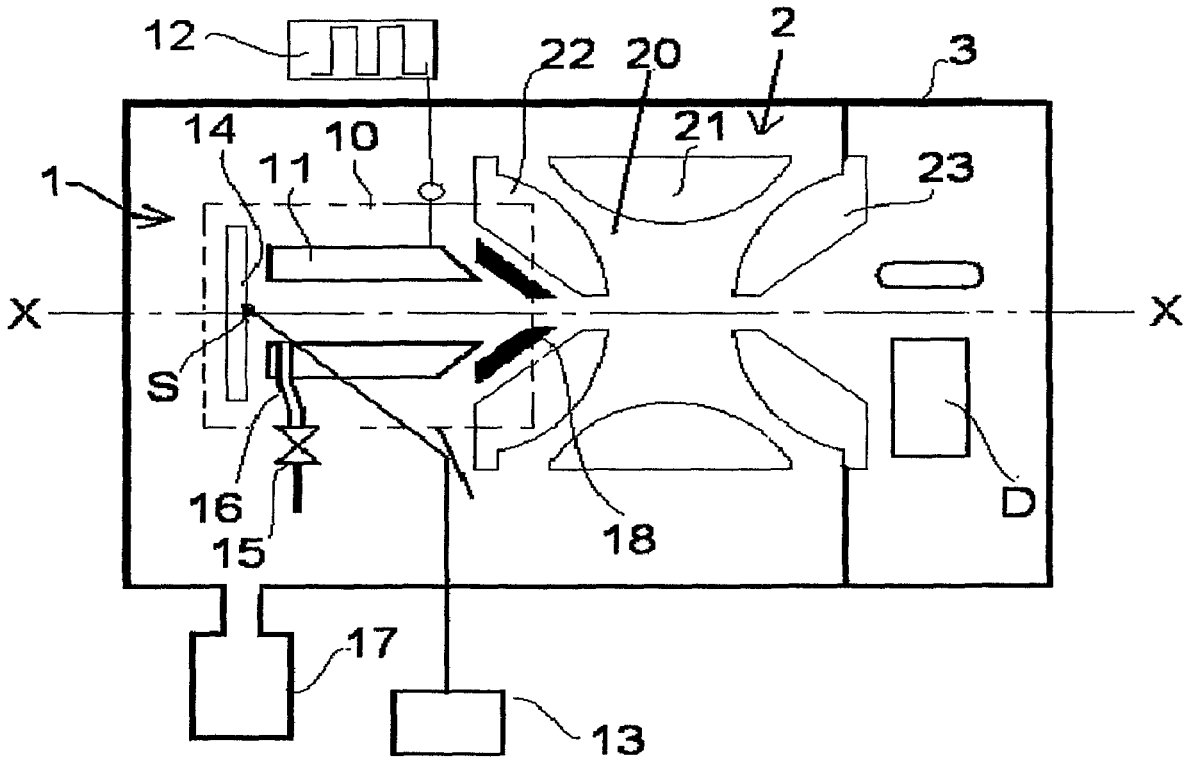
FIG. 1 is a diagrammatic, longitudinal cross-sectional representation of a mass spectrometer according to the invention.

Referring to FIG. 1, the mass spectrometer has an ionisation region 1 and a mass analysis region 2 housed within a vacuum enclosure 3. It will be appreciated that all the embodiments described hereinafter include a vacuum enclosure, but for simplicity this is only illustrated in FIG. 1. The ionisation region 1 includes a first ion trap 10 which is used to trap ions generated by a pulsed ion source, and the mass analysis region 2 includes a second ion trap 20 effective to receive and analyse ions ejected from the first ion trap 10. The mass analysis region 2 also includes an ion detector D for the detection of ions ejected from the second ion trap 20.

In this embodiment of the invention the first ion trap 10 is a quadrupole linear ion trap whereas the second ion trap 20 is a hyperboloid 3-D ion trap comprising a ring electrode 21 and two end cap electrodes 22, 23.

The two ion traps 10, 20 are arranged in series on a common longitudinal axis X-X. The quadrupole linear ion trap comprises four mutually parallel poles 11 arranged symmetrically around the longitudinal axis. The poles 11 are supplied, in use, with a high frequency rectangular waveform digital drive voltage generated by a drive unit 12 in the form of a high voltage digital switching circuit. It will be appreciated that any other suitable form of high frequency drive voltage; for example, a sinusoidal waveform drive voltage could alternatively be used. A sinusoidal waveform drive voltage may have a frequency in the range from radio frequency to audio frequency (suitable for ions having very high mass-to-charge ratio). As will be described in greater detail hereinafter the drive voltage creates a high frequency quadrupole field which is effective to constrain radial ion motion inside the ion trap.

The second ion trap 20 is driven in similar fashion, but more controlled scanning functions for mass analysis may be provided.

The ionisation region 1 includes a pulsed ion source comprising, a pulsed laser 13 arranged to direct pulses of laser radiation onto a sample S via a suitable optical system whereby to generate ion pulses. The sample S is deposited on an electrically conductive sample plate 14 which forms an end wall of the first ion trap 10. Therefore, ions generated by pulsed irradiation of sample S are actually produced inside the ion trap, and this gives improved trapping efficiency. The sample plate 14 is suitably positioned with respect to the laser beam using a motor-driven X-Y manipulator stage (not shown). This arrangement allows multiple samples deposited on the sample plate to be individually analysed without reloading the sample.

In this particular embodiment of the invention, the pulsed ion source is the preferred MALDI ion source, the sample material being mixed with radiation absorbing material to form a matrix which is deposited on the sample plate 14 for exposure to pulses of laser radiation. This arrangement assists the ionisation process. Alternatively, other known forms of pulsed ion source could be used, such as, pulsed secondary ion emission, fast atom bombardment and electron induced ionisation sources.

The ionisation region 1 also includes an electromagnetically-driven solenoid valve 15 (or alternatively a piezoelectrically-driven valve) for locally injecting a high pressure pulse of cooling gas (e.g. Ar or He gas) into the interior of the first ion trap 10 via an inlet tube 16 located close to the front end of the ion trap, and a high-speed pump 17 such as a turbomolecular pump for subsequently reducing the pressure of the cooling gas within the ion trap to a pressure less the $5\times10^{-3}$ mbar. The distance over which gas travels between valve 15 and the first ion trap 10 should be as short as possible. The length of tube 16 should be less than twenty times the tube diameter, allowing injected gas to be rapidly pumped out, resulting in a shorter pressure decay tail.

The first ion trap 10 has a conical gate electrode 18 located at the rear end of the ion trap. As will be described, the gate electrode 18 is used to eject ions from the ion trap but is also used to assist the trapping process.

A DC voltage source (not shown) biases the sample plate 14 at a first DC potential with respect to the average axial DC potential on the poles 11 and biases the gate electrode 18 at a second DC potential with respect to the average axial DC potential on the poles. While ions are being trapped in the first ion trap, the first and second DC potentials are both either more positive or more negative than the average DC potential on the poles according to whether the trapped ions are positively charged ions or negatively charged ions respectively. Therefore, in the case of positively charged ions, the flat sample plate 14 and the gate electrode 18 are both biased at DC potentials that are more positive than the average DC potential on the poles 11. The DC bias voltage may be in the range from several tens of volts to several hundreds of volts depending on the mass range of the ions that are to be trapped and the length of the linear ion trap 10, and the DC potential on the gate electrode 18 is preferably, though not necessarily less than the DC potential on the sample plate 14. The DC potentials on the flat sample plate 14, the gate electrode 18 and the poles 11 are as such as to create a potential well on the longitudinal axis of the first ion trap 10, the bottom of the potential well being located adjacent the gate electrode 18, as illustrated by curve 21 of FIG. 2.

As already explained, high-mass ions generated by the pulsed ion source (e.g. ions having masses greater than 10,000 Da) will generally have high kinetic energies, typically up to 100 eV, and this energy must be reduced before ions can be efficiently trapped within the first ion trap 10. To that end, a high pressure pulse of cooling gas is injected into the ion trap via tube 16. This causes rapid cooling of the pulsed ions with a consequent reduction of their kinetic and internal energies, enabling ions to be trapped within the first ion trap 10 under the influence of the quadrupole electric field generated by the rectangular waveform digital drive voltage applied to the poles 11.

In order to trap ions, particularly the more energetic, high mass ions, the pulse of cooling gas should have a high peak pressure which is then rapidly reduced by pumping so that ions can easily migrate to a suitable location within the first ion trap for subsequent ejection.

In order to build up gas pressure quickly high pressure gas is supplied to the inlet of valve 15. Typically, Helium or Argon gas at a pressure of one atmosphere or more is used. An electrical activation pulse used to hold valve 15 open may be as short as 100 μs, and may have a voltage more than ten times that needed to hold the valve open continuously. The actual valve opening time will depend on the valve head restoration time, but should be less than the pump down time constant of the vacuum system, and is typically less than 5 ms. While the inlet valve 15 is open, the gas pressure created within the vacuum system rapidly increases. In theory, the vacuum system will reach an equilibrium pressure after the pump down time constant. This is defined as the volume of the ion trap chamber divided by the effective pumping speed. For example, assuming that the vacuum chamber has a volume of 1 liter and the effective pumping speed for the chamber is 50 liters per second the pump down time constant is 20 ms. This time interval is the time needed to approach an equilibrium pressure starting from the time when the inlet valve 15 is opened. The high pressure head at the valve inlet might result in a pressure well above $10^{-1}$ mbar, and this would prevent the turbomolecular pump from operating if the inlet valve 15 were to be held open continuously. However, the inlet valve 15 is closed (typically after <5 ms) well before the equilibrium pressure is reached and so the only region of the first ion trap chamber exposed to the high initial pressure is that in the immediate vicinity of the gas inlet tube 16, and this pressure will start to fall as soon as the inlet valve 15 is closed. With a pump down time constant of 20 ms, the pressure within the ion trap chamber may fall from $5\times10^{-2}$ mbar to below $1\times10^{-3}$ mbar in about 60 ms. It will be appreciated that this time estimate does not take account of the detailed structure within the ion trap chamber, nor the influence of absorption/desorption and so, in reality, a longer time interval may be needed. Nevertheless, the described operating procedure does enable a short, high pressure gas pulse to be generated causing rapid cooling of high kinetic energy ions generated within the ion trap by the pulsed ion source without the need for any differential pumping. After a pulse of cooling gas has been injected into the vacuum system there will be a delay (typically 10 ms) before the pulsed ion source is activated, in order to allow the gas pressure to build up. It normally takes 60 ms or more to pump the gas pressure down and so it is possible to direct a succession of laser pulses onto sample S during that period so as to generate additional ions for analysis during the same analysis cycle.

As the pressure of cooling gas is reduced by pumping, trapped ions are able to migrate towards the bottom of the afore-mentioned potential well where they may congregate to form a short, ovoid ion cloud and the trapped ions may subsequently be ejected from this low energy region.

Before any ions are ejected from the first ion trap 10, a the rectangular waveform digital drive voltage supplied to the second ion trap 20 is either switched off altogether or is set at a reduced level lower than that determined by the mass range of ions that are to be analysed so as to enable ejected ions to enter the trapping volume of the second ion trap 20. In this regard, use of a high frequency rectangular waveform digital drive voltage generated by a switching circuit is advantageous because it can be readily switched off.

Figure 2:
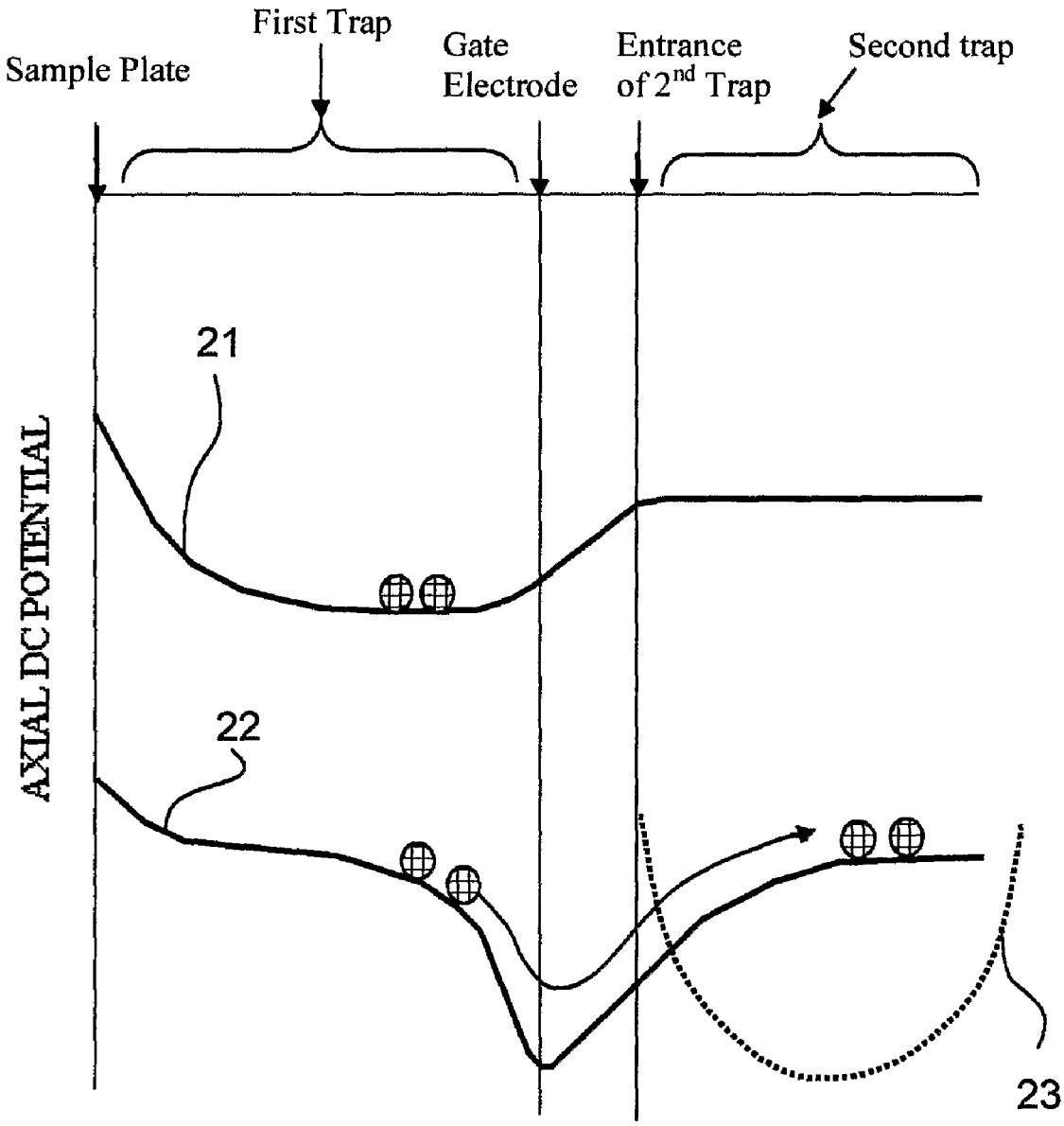
FIG. 2 illustrates a variation of axial DC potential in the first and second ion traps of the mass spectrometer of FIG. 1 during both the trapping and ejection of ions.

In order to eject trapped ions from the first ion trap 10, the gate electrode 18 is biased at a DC potential that is less positive (for positively charged ions) or less negative (for negatively charged) than the average DC potential on poles 11. Curve 22 of FIG. 2 illustrates the variation of DC potential along the axis of the first ion trap during the ejection process and, as will be clear from curve 22, the DC potential on the gate electrode 18 is well below (typically several tens to several hundreds of volts below) the DC potential on poles 11, thereby subjecting the trapped ions to an accelerating force towards the gate electrode 18 causing their rapid ejection from the first ion trap.

For analyte ions having a mass of 10,000 Da the time needed for ejected ions to reach the centre of the second ion trap may be 40 to 50 μs, and ions having higher or lower masses than this will require longer or shorted times respectively. As shown by curve 22 of FIG. 2, the DC potential on the entrance end cap electrode 22 of the second ion trap 20 is set so as to subject the ejected ions to a retarding force in the second ion trap. The variation of DC potential on the longitudinal axis of the second ion trap 20 can be tailored to have a substantially inverted quadratic form, as shown in FIG. 2, and so the lighter, faster ions, which enter the second ion trap first, are slowed down allowing the heavier, slower ions to catch up thereby widening the mass range of ions that can be trapped in the second ion trap and improving the efficiency of transfer. When substantially all the ejected ions have reached the centre of the second ion trap 20 the high frequency rectangular waveform digital drive voltage is switched back on, or restored to its normal level, creating a psuedopotential well for trapping the ions that were transferred. This is represented by curve 23 of FIG. 2.

While cooling gas is being supplied to, and pumped from the first ion trap 10, some of the cooling gas may diffuse into the second ion trap 20. When ions are transferred from the first ion trap 10 to the second ion trap 20 the pressure of the cooling gas in the second ion trap 20 could reach a pressure of about $1\times10^{-3}$ mbar, which is entirely suitable for cooling ions and carrying out mass analysis procedures. Such mass analysis procedures include precursor isolation, collision induced dissociation and mass dependent ejection, and are well known to persons of ordinary skill in the art.

The first ion trap 10, described with reference to FIG. 1, has a single set of poles 11 and it proves difficult satisfactorily to adjust the variation of DC potential along the axis of ion trap unless the poles 11 are relatively short.

FIG. 3(*a*) shows an alternative embodiment of the invention which alleviates this problem; in all other respects its operation is substantially the same as the embodiment described with reference to FIG. 1. Many of the component parts shown in FIG. 3(*a*) are in common with those shown in FIG. 1 and are ascribed like reference numerals.

Referring to FIG. 3(*a*), each pole 11 is segmented, comprising a relatively long segment $\mathbf{11}^{1}$ and a shorter segment $\mathbf{11}^{11}$ adjacent to the gate electrode 18. In this embodiment, the high frequency rectangular waveform digital drive voltage is supplied to both segments $\mathbf{11}^{1}$, $\mathbf{11}^{11}$ of the poles via a capacitive coupling 30, and a DC voltage source 31 supplies a DC bias voltage to the shorter segment $\mathbf{11}^{11}$ reducing the axial DC potential on the segment with respect to both the axial DC potential on the longer segment $\mathbf{11}^{1}$ and on the gate electrode 18 thereby creating a relatively narrow potential well within which a relatively short packet of ions may be trapped. When the packet of ions is to be ejected from the first ion trap 10, the DC potential on the gate electrode 18 is reduced below the DC potential on the shorter segment $\mathbf{11}^{11}$ causing rapid acceleration of the ion packet out of the first ion trap 10 towards the second ion trap 20.

A further advantage of using a segmented linear ion trap is that the effect of fringing fields is much reduced, making removal of unwanted ions easier. After the pressure of cooling gas has been reduced to a pressure below $10^{-3}$ mbar, unwanted ions may be ejected from the ion trap by application of a suitable mass selective ejection process. This may involve application of a quadrupole DC voltage to the poles while the amplitude and or frequency of the high frequency drive voltage is adjusted so as to retain, for subsequent analysis in the second ion trap 20, only those ions in a selected mass-to-charge ratio and thereby achieve an acceptable mass resolution for precursor ion selection (up to a few hundreds). Alternatively, the mass selective ejection process may involve use of a broadband supplementary drive voltage using the known "SWIFT" or "FNT" technologies, for example.

In a different embodiment, shown in FIG. 3(*b*), the first ion trap 10 includes a ring electrode 32 positioned between the poles 11 and the gate electrode 18. The DC voltage source 31 biases the ring electrode 32 with a DC potential which is a few volts lower than the average axial DC potential on the poles 11 creating an axial potential well at the centre of the ring electrode 32. Ions that have been cooled by the cooling gas will steadily migrate to this point and become trapped in the axial direction by the DC potential well being constrained in the radial direction by the fringing quadrupole field generated by the high frequency drive voltage supplied to the poles 11, and they remain in the potential well until they are ejected from the first ion trap 10 by reducing the DC potential on the gate electrode 18 in the manner already described.

FIG. 4 shows yet another embodiment of the invention. Again, many of the component parts shown in FIG. 4 are in common with those shown in FIGS. 1 and 3 and are ascribed like reference numerals. In this embodiment, a cylindrical ion trap 40 replaces the linear ion trap 10 of the embodiments described with reference to FIGS. 1 and 3.

The cylindrical ion trap 40 comprises a cylindrical ring electrode 41 which is supplied with a suitable high frequency drive voltage which may be a high frequency rectangular waveform digital drive voltage or alternatively a sinusoidal waveform drive voltage.

As before, the sample plate 14 forms an end wall at the front end of the ion trap 40 and, in this embodiment, the gate electrode 18 also forms an end wall at the rear end of the ion trap 40. Again, the pulsed ion source is a MALDI ion source and in this embodiment laser pulses are directed onto the sample S along the longitudinal axis X-X of the first and second ion traps. Alternatively, the laser pulses could be directed onto the sample via a suitable window formed in the cylindrical ring electrode 41. A sample mask 42 is also provided. A part of sample S which is to be exposed to the laser pulses is aligned with an opening 43 in the sample mask 42 whereas other parts of the sample S are protected from such exposure, and from exposure to ions generated as a result of the ionisation process. The timing of the laser pulses preferably has a predetermined phase relationship with respect to the waveform of the drive voltage applied to the cylindrical ring electrode 41. As illustrated in FIG. 5, the optimum timing for the generation of positively-charged ions is when the phase of the drive voltage is between 270° and 350°, as represented by arrow 51, whereas the optimum timing for the generation of negatively-charged ions is when the phase of the drive voltage is between 90° and 170°, as represented by arrow 52, these phases being referenced with respect to 0° phase which occurs at the zero crossing time on the rising part of each waveform. As described before, a pulse of cooling gas is injected into the interior of the first ion trap 40 via tube 16 and the pressure of cooling gas is subsequently reduced by pumping. Again, the timings of the pulsed irradiation of sample S and of the injection of cooling gas are synchronised, with a short delay after the cooling gas is injected. As a result of this, an ion cloud is trapped at the centre of the first ion trap 40.

In order to eject the trapped ions a dipole electric field is rapidly established between the sample plate 14 and the gate electrode 18 subjecting the trapped ions to an accelerating force in the direction of the second ion trap 20. At the same time, a dipole electric field, of opposite polarity, is established between the two end cap electrodes 22, 23 of the second ion trap 20 whereby ions entering the trapping volume of the second ion trap 20 are retarded and brought to a halt near the centre of the ion trap. While ions are being transferred in this way, the high frequency drive voltages supplied to both ion traps are turned off or set at a reduced level. An additional electrostatic lens 44 is provided between the first and second ion traps 40, 20 to focus ions as they are being transferred.

A variation of axial DC potential on axis X-X can be modified by appropriately biasing the sample plate 14, gate electrode 18 and ring electrode 41 of the first ion trap 40 and the two end cap electrodes 22,23 and the ring electrode 21 of the second ion trap 20, and this can be used to influence the characteristics of ion transfer whether to improve the efficiency with which ions are transferred between the ion traps and/or to increase the mass range of ions that are transferred. PCT/CA2005/00086 describes an ion trap arrangement having a tunnel structure formed from printed circuit board (PCB) bearing electrically conductive tracks that can be used to generate electric fields required for ion trapping, transmission of ions between trapping and analysis sections of the arrangement, and ion analysis.

FIG. 6 shows another embodiment of the invention which is based on this kind of arrangement.

Referring to FIG. 6, the mass spectrometer comprises a first linear ion trap 61 and a second linear ion trap 71 which are arranged in series on a common longitudinal axis X-X.

As already described, the two ion traps 61,71 have a tunnel structure, being formed from PCB 62 bearing electrically conductive tracks supplied with appropriate high frequency drive and DC bias voltages. As before, the first ion trap 61 is used to trap ions generated by a pulsed ion source and the second ion trap 71 is used to receive and analyse ions ejected from the first ion trap 61. Again, the pulsed ion source is the preferred MALDI ion source. Laser pulses are directed along axis X-X and are focused by a suitable lens system 69 onto sample S deposited on a sample plate 65 which forms an end wall at the front end of the first ion trap 61.

The two linear ion traps 61,71 are separated by a gate electrode 63 having an orifice. Ions generated by the pulsed ion source are trapped within the first ion trap 61 with the assistance of pulsed cooling gas introduced into the interior of the first ion trap 61 via tube 67 in the manner already described with reference to the earlier embodiments. As before, the pressure of cooling gas is reduced by pumping.

The electrically conductive tracks are capable, when supplied with suitable high frequency drive and DC bias voltages, of generating trapping multipole fields for confining ions in the radial direction and DC fields for trapping or transferring ions axially within the tunnel structure. By this means, ions trapped in the first ion trap 61 are readily transferred to the second ion trap 71 in known manner for analysis. The second ion trap 71 includes an ion detector 64 which detects ions ejected from the second ion trap 71 by a mass selective ejection technique in a direction orthogonal to axis X-X.

FIG. 7 shows an alternative embodiment of the invention having a tunnel structure similar to that described with reference to FIG. 6. This embodiment has component parts in common with the embodiment described with reference to FIG. 6, and these are ascribed like references numerals.

The embodiment differs from that of FIG. 6, in that the first and second ion traps 61,71 are arranged side-by-side on mutually parallel axes X-X, Y-Y. As before, the first ion trap 61 is used to trap ions generated by a pulsed ion source (again a MALDI ion source) with the assistance of pulsed, high pressure cooling gas introduced into the interior of the ion trap via tube 67. Again, the sample plate 65 forms an end wall of the first ion trap 61 and laser pulses are focused onto sample S along axis X-X. Trapped ions are ejected from the first ion trap 61 and are transferred via a suitable slit or hole into the second ion trap 71, for analysis, in a direction orthogonal to axes X-X and Y-Y. This may be accomplished using dipole acceleration in the first ion trap 61 and dipole retardation in the second ion trap 71 in similar fashion to the ejection process described with reference to FIG. 3. In this embodiment, the required transverse electrical fields are generated by application of suitable pulsed voltage to electrically conductive tracks on the PCB structure. As in the case of the embodiment described with reference to FIG. 6, the second ion trap 71 includes an ion detector 64 which detects ions ejected from the second ion trap 71 using mass selective ejection in a direction orthogonal to axes X-X and Y-Y. Furthermore, provided the pressure of cooling gas in the first ion trap 61 is reduced by pumping to an appropriate level, ions in a selected mass range may be transferred to the second ion trap 71 using mass selective resonance ejection whereby tandem mass analysis can be carried out.

In general, the described embodiments employ a pulsed ion source in combination with a dynamic gas pressure enabling high efficiency cooling of ions as well as improved ion mobility during ion transportation thereby reducing or eliminating the need for differential pumping which would otherwise add to the cost and complexity of the instrument, and improving the efficiency with which ions maybe trapped in the first ion trap and subsequently ejected for mass analysis in the second ion trap. Whereas some embodiments have been described with reference to positively charged ions, negatively charged ions may be readily accommodated by simple reversing polarities as necessary as will be apparent to those of ordinary skill in the art.

The invention claimed is:

1. A mass spectrometer including:

a pulsed ion source, a first ion trap for trapping ions generated by the pulsed ion source and for locating trapped ions for subsequent ejection from the first ion trap, a gas inlet means for introducing a pulse of cooling gas into said first ion trap at a peak pressure suitable for enabling the first ion trap to trap said ions, a pump means for reducing a pressure of said cooling gas before the trapped ions are ejected from the first ion trap, and a second ion trap for receiving and analyzing ions ejected from the first ion trap, said pulsed ion source including a flat sample plate on which a sample is deposited and which forms an end wall of the first ion trap, whereby said pulsed ions are generated inside the first ion trap, and said gas inlet means including a valve having an opening time less than the pump down time constant achieved by said pump means.

2. A mass spectrometer as claimed in claim 1 wherein said pulsed ion source includes a laser and means for directing pulses of laser radiation onto said sample.

3. A mass spectrometer as claimed in claim 2 wherein said pulsed ion source is a MALDI ion source.

4. A mass spectrometer as claimed in claim 1 wherein said valve opening is less than 5 ms.

5. A mass spectrometer as claimed in claim 1 wherein said pump means is a turbomolecular pump.

6. A mass spectrometer as claimed in claim 1 wherein said gas inlet means includes an electromagnetically-driven valve.

7. A mass spectrometer as claimed in claim 1 wherein said gas inlet means includes a piezoelectrically-driven valve.

8. A mass spectrometer as claimed in claim 1 wherein said gas inlet means introduces said pulse of cooling gas into the first ion trap at a peak pressure in the range from $5\times10-2$ mbar to 1 mbar.

9. A mass spectrometer as claimed in claim 8 wherein said pump means reduces said pressure to a pressure less than $5\times10-3$ mbar.

10. A mass spectrometer as claimed in claim 1 wherein there is a preset delay between activation of said gas inlet means and subsequent activation of said pulsed ion source.

11. A mass spectrometer as claimed in claim 1 wherein said first ion trap is a multipole linear ion trap.

12. A mass spectrometer as claimed in claim 11 wherein said multipole linear ion trap includes a gate electrode located at a rear end of said first ion trap, said gate electrode being selectively biased to reflect or eject ions.

13. A mass spectrometer as claimed in claim 12 which said gate electrode is biased to create an axial DC potential well in the first ion trap whereby to locate a cloud of said trapped ions in the first ion trap prior to their ejection from the first ion trap.

14. A mass spectrometer as claimed in claim 13 which said multipole linear ion trap is a segmented multipole linear ion trap wherein each pole includes a relatively short segment adjacent to said rear end of the first ion trap, each said relatively short segment being biased to augment said DC axial potential well.

15. A mass spectrometer as claimed in claim 13 including a ring electrode between said gate electrode and the poles of said first ion trap, the ring electrode being biased to augment said DC axial potential well.

16. A mass spectrometer as claimed in claim 12 wherein said gate electrode is biased to subject ions to an electrostatic accelerating force towards the gate electrode causing the ejection of ions from the first ion trap towards the second ion trap.

17. A mass spectrometer as claimed in claim 11 wherein the multipole linear ion trap is a quadrupole linear ion trap.

18. A mass spectrometer as claimed in claim 1 wherein said first ion trap is a cylindrical ion trap including a ring electrode having a longitudinal axis, wherein said flat sample plate forms said end wall of the ion trap at a front end thereof and a gate electrode forms an end wall of the ion trap at a rear end thereof.

19. A mass spectrometer as claimed in claim 18 wherein said pulsed ion source is activated when the phase of a high frequency drive voltage supplied to said ring electrode is in the range 90° to 170° for negatively charged ions and 270° to 340° for positively charged ions, where said phase is expressed with respect to the zero crossing time on the rising part of the drive voltage waveform.

20. A mass spectrometer as claimed in claim 18 wherein ions are located to form an ion cloud at the geometric centre of the cylindrical ion trap before the ions are ejected.

21. A mass spectrometer as claimed in claim 18 including DC biasing means arranged to establish a dipole electric field between said flat sample plate and said gate electrode to cause ejection of trapped ions from the first ion trap, and said second ion trap is arranged to establish a further dipole electric field for retarding ejected ions.

22. A mass spectrometer as claimed in claim 1 wherein said second ion trap is one of a hyperboloid 3-D ion trap or a quadrupole linear ion trap.

23. A mass spectrometer as claimed in claim 1 wherein the first and second ion traps are both linear ion traps.

24. A mass spectrometer as claimed in claim 1 wherein said first and second ion traps are arranged in series on a common longitudinal axis.

25. A mass spectrometer as claimed in claim 1 wherein said first and second ion traps are arranged side-by-side on mutually parallel axes and means for ejecting trapped ions is arranged to eject ions from the first to the second ion trap in a direction orthogonal to said parallel axes.

26. A mass spectrometer as claimed in claim 1 wherein said first and/or said second ion traps have a tunnel structure formed from a printed circuit board bearing electrically conductive tracks to which an RF drive and a DC bias voltage are applied in use.

27. A mass spectrometer as claimed in claim 1 wherein at least one of said first or second said ion traps is driven by a rectangular waveform digital drive voltage generated by a switching circuit.

* * * * *